US005177912A

United States Patent [19]

Ball

[11] Patent Number: 5,177,912

[45] Date of Patent: Jan. 12, 1993

[54] COMPUTER WORKSTATION

[76] Inventor: Douglas Ball, 178 Senneville Rd., Senneville, Quebec, Canada H9X 3L2

[21] Appl. No.: 591,788

[22] Filed: Oct. 2, 1990

[51] Int. Cl.[5] ..... E04B 1/74

[52] U.S. Cl. ..... 52/36; 52/239; 52/64; 472/60

[58] Field of Search ..... 52/64, 239, 36; 472/130, 60, 59; 297/172, 184

[56] References Cited

U.S. PATENT DOCUMENTS

| | | | |
|---|---|---|---|
| 2,496,752 | 2/1950 | Rose . | |
| 3,462,852 | 8/1969 | Emerson | 35/8 |
| 3,845,591 | 11/1974 | Stine | 52/67 |
| 4,121,303 | 10/1978 | Reece | 2/205 |
| 4,314,280 | 2/1982 | Rose | 358/255 |
| 4,478,407 | 10/1984 | Manabe | 272/18 |
| 4,562,482 | 12/1985 | Brown | 358/254 |
| 4,577,928 | 3/1986 | Brown | 350/276 |
| 4,710,129 | 12/1987 | Newman et al. | 434/55 |
| 4,784,468 | 11/1988 | Tierney | 350/276 |
| 4,856,242 | 8/1989 | Baloga et al. | 52/239 |
| 4,863,242 | 9/1989 | Correa | 350/276 |

*Primary Examiner*—Richard E. Chilcot, Jr.
*Assistant Examiner*—Matthew E. Leno
*Attorney, Agent, or Firm*—Ratner & Prestia

[57] ABSTRACT

A workstation for providing a relatively isolated environment suitable for human to interface during long time periods with a computer through a display screen. The space partition assembly comprises an elongated canopy defining a working area dimensioned to accommodate a user adopting a reclining posture. The canopy also includes at one end thereof an entryway to allow access to the working area by means of a sliding seat supporting the user. On the back of the seat is provided a large panel which at least partially closes the entryway when the working area is occupied by the user to reduce disturbances such as noise or light from reaching the working area.

10 Claims, 4 Drawing Sheets

COMPUTER WORKSTATION

FIELD OF THE INVENTION

The invention relates to the general field of office equipment and more specifically to a partition arrangement for providing a relatively isolated work space well suited for long work sessions involving the use of a display screen.

BACKGROUND OF THE INVENTION

During the past recent years, personal computers have become an increasingly popular tool for office workers. In a typical office arrangement, the display screen of the computer is placed on an ordinary secretarial-type desk for observation by the user in a sitting position. This set-up has been designed primarily for multi-task office workers whose duties do not require long computer work sessions. An example is a secretary who must perform a plurality of tasks without leaving her workstation, such as conducting correspondance, answering the telephone, filing papers and only occasionally interfacing with the computer through the display screen.

This working environment is not well-suited for performing long and sustained computer work sessions where the user must be able to keep his concentration as long as possible. One reason is the glare on the display screen caused by ambient light which after a certain time produces eye strain and the resultant loss of concentration. Secondly, the open area arrangement often adopted for secretarial-type work stations exposes the user to external stimuli such as noise and strong lighting conditions producing distraction. Thirdly, the chair used with secretarial type work stations is not optimized to provide comfort during long time periods because it is designed to maintain the back of the body in a virtually upright position and as a result, most of the body weight is supported on the posterior creating pressure points and discomfort. Accordingly, the user is tempted to change its position on the chair often, which produces distraction.

The problem of glare on display screens has been recognized and addressed in the past recent years by those skilled in the art. In an attempt to provide an efficient solution, glare reducing filtering devices have been proposed either in the form of screen shields or eye-glasses for the user. Although these solutions can enhance the user concentration by diminishing eye strain, distractions from external stimuli and an uncomfortable sitting position still contribute to decrease the worker's level of productivity and performance.

OBJECT AND STATEMENT OF THE INVENTION

An object of the invention is a workstation providing a relatively isolated environment suitable for a human to interface during relatively long time periods with a display screen.

The workstation, according to the invention, comprises:

a) an elongated canopy defining a relatively isolated working area dimensioned to at least partially accommodate a user adopting a reclining posture, the canopy including at one end thereof an entryway allowing the user to access and exit the working area while in the reclining posture;

b) means for supporting a display screen mounted within said elongated canopy in a spaced apart relationship to said entryway to reduce glare on a display screen caused by ambient light penetrating in said canopy through said entryway; and c) a seat for supporting a user in a reclining posture, the seat being movable with relation to the canopy allowing a user to pass through the entryway for accessing/exiting the working area.

In a preferred embodiment, the workstation is built as a unit with all its components supported on a common base plate. The seat is slidingly mounted in tracks provided on the base plate. To enhance the sense of privacy in the working area and to further block external disturbances, a panel is mounted on the back of the seat to extend in adjacency to the entryway when the user is in the working area, for at least partially closing the entryway to prevent such disturbances from reaching the working area.

The position that the user adopts when sitting in the chair is an important aspect of the invention as it has been observed that it allows to considerably reduce fatigue and discomfort to prevent loss of concentration. The seat is designed so that the back is oblique, in other words, inclined from the vertical position, whereby the user will adopt a reclining posture (for the purpose of this specification, the terms "reclining position" or "reclining posture" should be construed to mean any sitting position where the back of the user is in an intermediary position between the perfectly horizontal and vertical positions). The reclining position allows a considerable portion of the body weight to be supported on the back, increasing the area of the human body in supporting contact with the seat. Accordingly, the pressure on the body per unit area will diminish allowing to achieve a considerably higher degree of comfort by comparison to an ordinary seat where the back of the user is virtually in the vertical position and only its posterior is in a supporting contact with the seat.

DESCRIPTION OF THE PREFERRED EMBODIMENT

Figure 1:
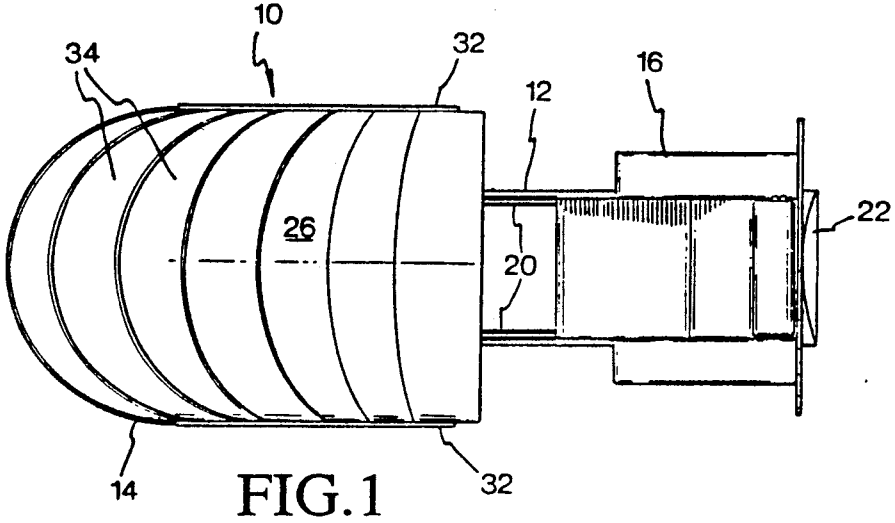
FIG. 1 is a top plan view of the computer workstation in accordance with the invention.
Figure 3:
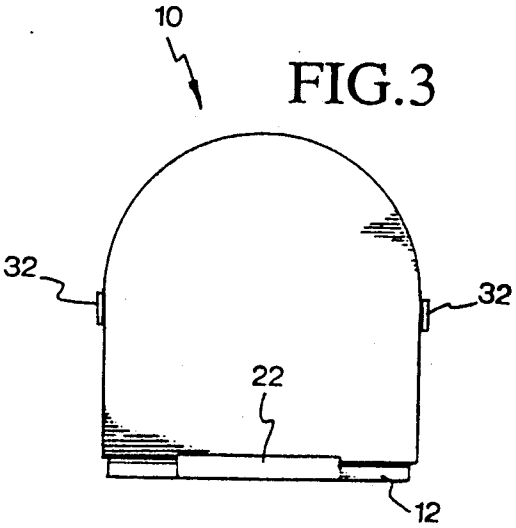
FIG. 3 is a rear elevational view of the workstation.

Referring now to FIGS. 1 to 6, the computer workstation, identified generally by the reference numeral 10 comprises a base plate 12 supporting a generally dome-shaped canopy 14 and a sliding seat 16.

The base plate 12 can be made of any appropriate material that provides the necessary strength and resistance characteristics such as wood, metal or plastic material. The front section of the base plate 12 which supports the canopy 14 includes two straight and parallel longitudinal edges which progressively curve in the front portion of the plate 12 to form a semi-circular apex 18. The rear section of the base plate 12 carrying the seat 16 is rectangle shaped and is substantially narrower than the front section of the plate. On the top surface of the rear section are provided two longitudinally extending parallel tracks 20 running adjacent the lateral edges of the rear section. The tracks 20 originate under canpoy 14, and extend almost the entire length of the rear section stopping short of the rear end thereof which is provided with an upstanding stop 22.

Figure 2:
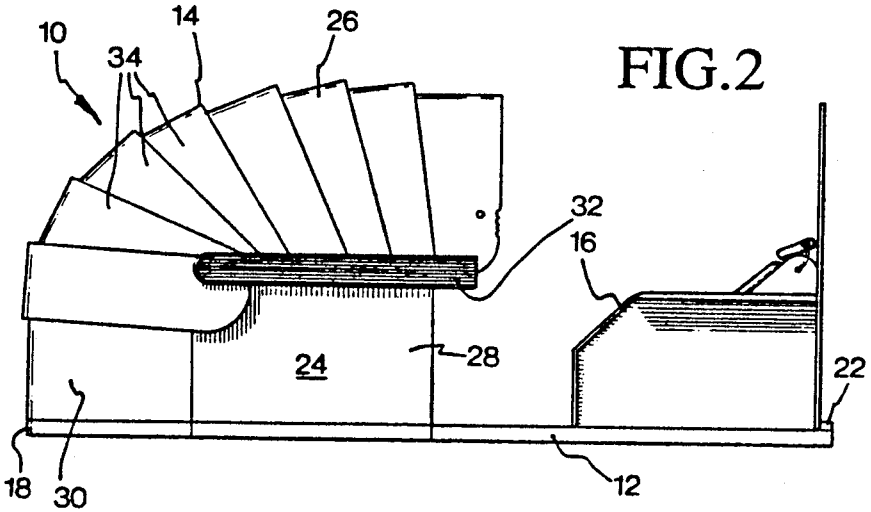
FIG. 2 is a side elevational view of the workstation.
Figure 4:
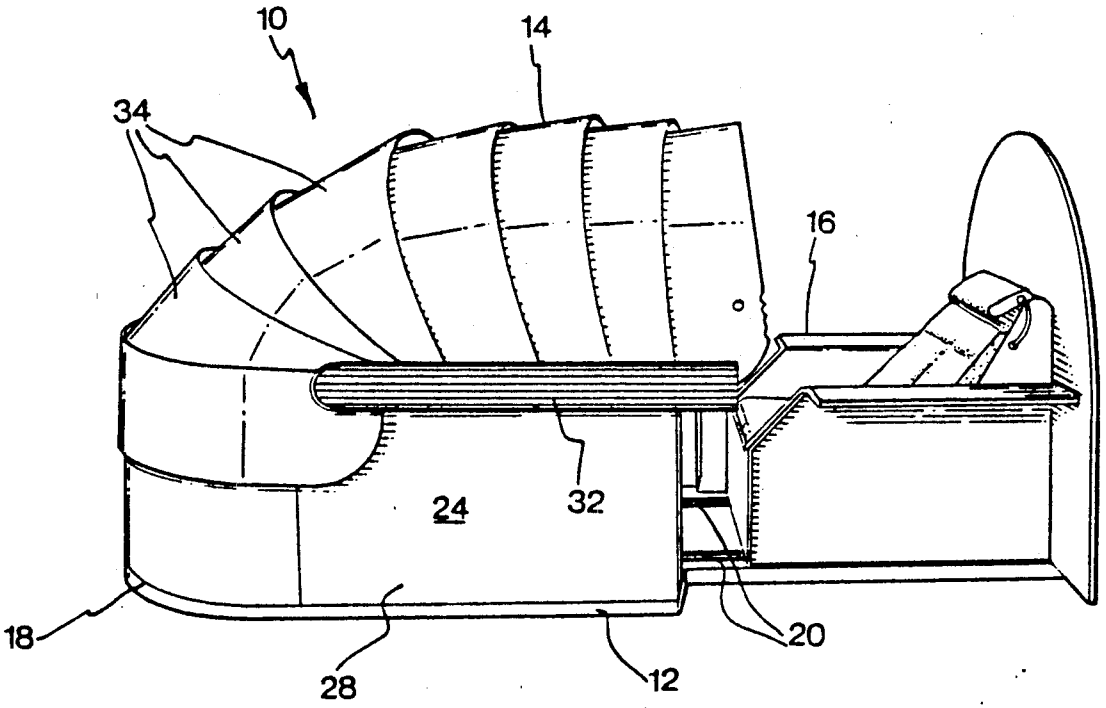
FIGS. 4, 5 and 6 are perspective views of the workstation from different angles.

The canopy 14, defining a blind tunnel-like structure, comprises a vertical side wall section 24 supporting an arched roof 26. The side wall section 24, whose shape corresponds to the contour of the front section of the base plate 12 includes two straight and flat panels 28 in opposing relationship joined by a curved panel 30 in registry with the apex portion 18 of the base plate 12. The panels 28 and 30 are made of thin wood or plastic whose exterior surface is provided with the desired finish. On each panel 28, adjacent its top horizontal edge, is mounted an elongated roof supporting member 32 to which all the components that constitute the roof 26 are attached. These are in the form of arched wooden strips 34 having end portions pivotally mounted to a respective support member 32. The arched strips 34 are in a partially overlapping relationship and accordingly, their radius of curvature progressively decreases from the strip near the apex portion 18 of the base plate toward the strip adjacent the seat 16. The pivotal mounting of the arched strips 34 allows to alter their mutual overlapping relationship. This feature is best illustrated by comparing the position of the strip 34 adjacent the seat 16 in FIGS. 2 and 4. In FIG. 2, the strip 34 is in the vertical position while in FIG. 4, it is slightly pivoted toward the front which has the effect of somewhat opening the roof section.

Figure 6:
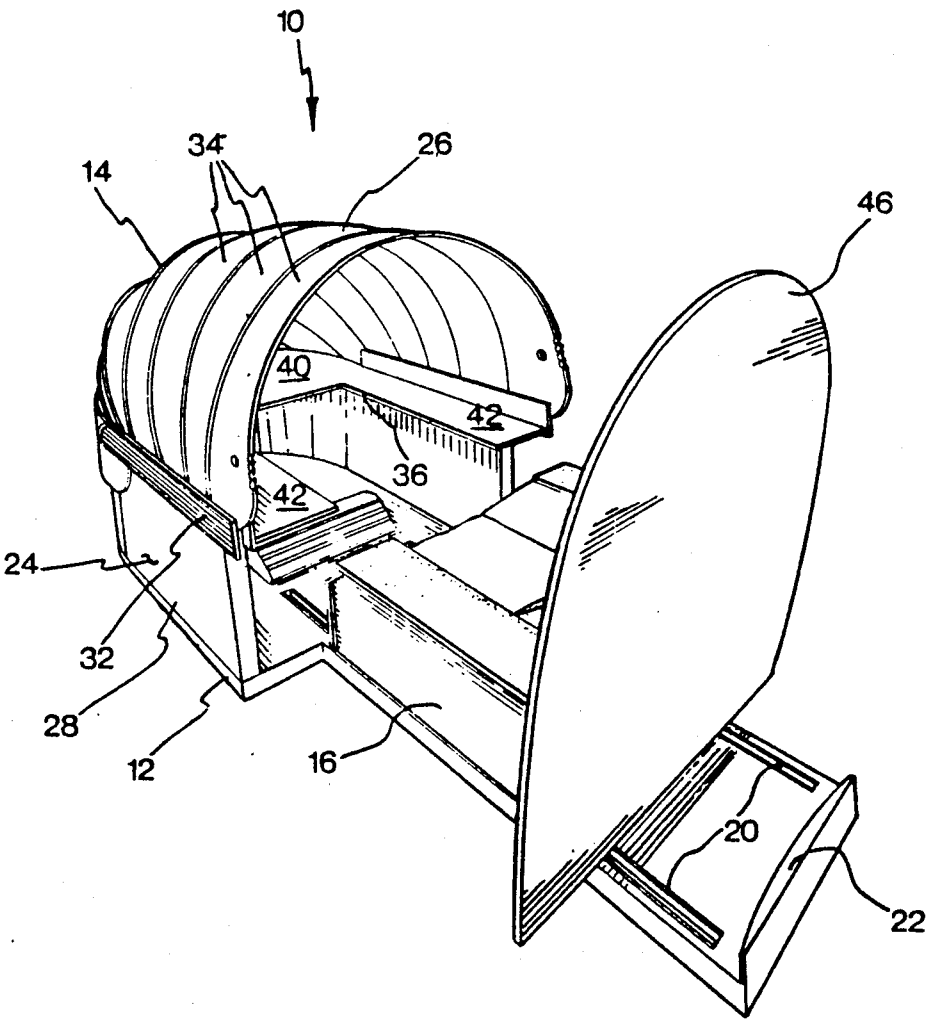
Figure 5:
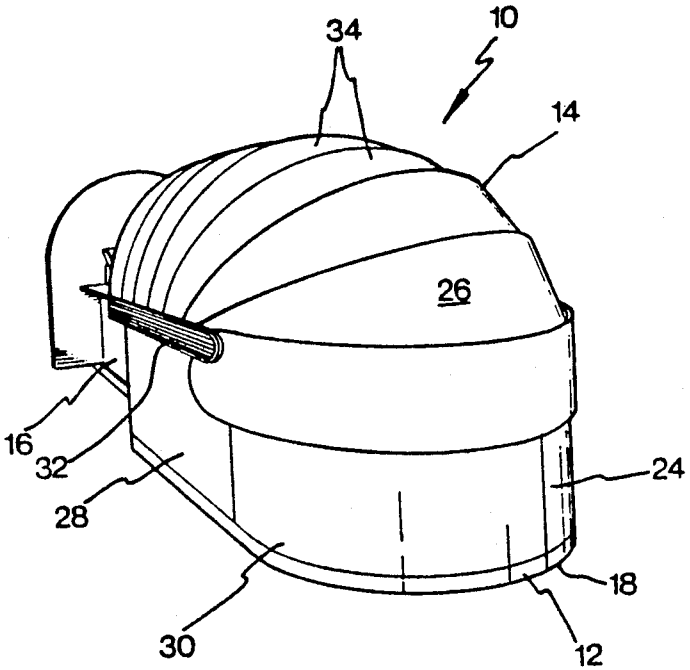
Figure 7:
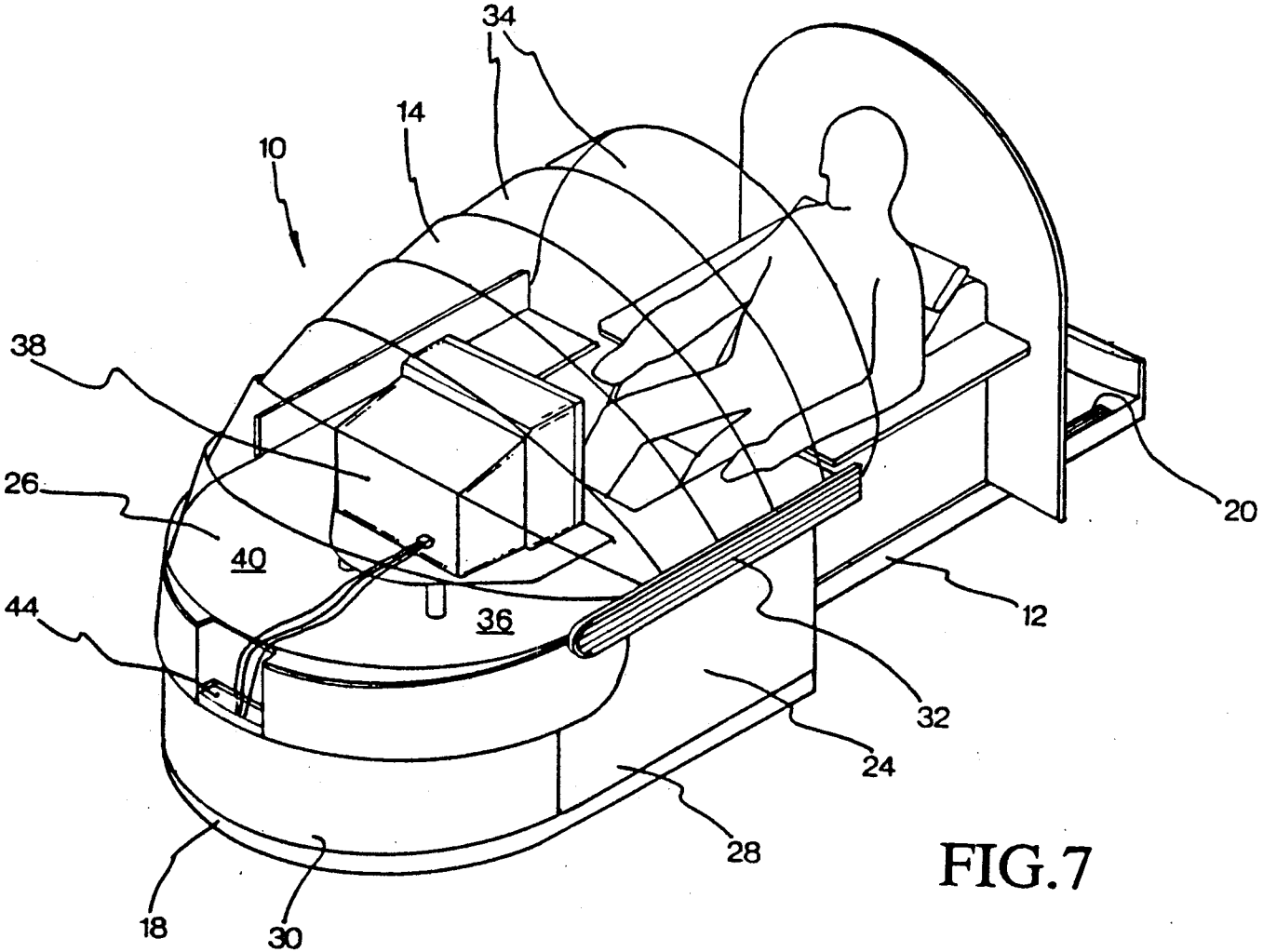
FIG. 7 is a schematical view of the workstation illustrating a user in a working position.

As best shown in FIGS. 6 and 7, within the canopy 14 is mounted a U-shaped desk 36 for supporting a display screen 38. The desk 36 comprises a main section 40 mounted deeply within the canopy 14 on which the display screen 38 is mounted and two parallel shelf-like panels 42 extending toward the open end of the canopy 14 which constitutes its entryway.

As illustrated schematically in FIG. 7, the electrical wiring necessary for the operation of the display screen 38 is routed in a passage 44 at the front portion of the workstation 10 and then goes back through a tunnel (not shown) extending longitudinally through the base plate 12.

The seat 16 is slidingly mounted in the tracks 20 to move relatively to the canopy 14. The range of seat motion depends on the track length and is limited at the rear end of the workstation 10 by the upstanding stop 22. The seat 16 is designed to maintain the user in a comfortable position for relatively long time periods such as several hours by keeping the body in a reclining posture which is achieved by supporting the back of the user in a position intermediate the horizontal and vertical positions. As it has been mentioned earlier, this posture permits to augment the supporting contact surface between the seat and the body, reducing the pressure points and the resulting discomfort.

On the back of the seat 16 is mounted a vertically extending panel 46 whose contour corresponds to the entryway of the canopy 14, i.e. having a generally rectangular lower portion and a semi-circular top portion.

In order to enter the workstation 10, the user slides the seat 16 up to the fully opened position where the panel 46 abuts the stop 22. Then the user sits into the seat 16 and moves the latter forwardly in order to enter, at least partially, the canopy 14. The working area which is available to the user is bounded by the U-shaped desk 36. This working zone does not need to be very large as during a work session with a computer, only small limb movements are required such as for actuating computer controls. How deep the seat will be brought within the canopy 14 depends on the user preference and the dimensions of the canopy itself. In most instances, the position which has been found to be most advantageous is as illustrated in FIG. 7, where the user is only partially covered by the canopy. In this position, the canopy provides a sense of privacy without creating a clostrophobic effect.

Since the display screen 38 is located deeply within the canopy, ambient light is intercepted by the canopy shell and also somewhat by the panel 46 to reduce glare. Accordingly, there is no need to provide any glare reduction devices such as filters, to prevent eye strain. The reclined posture of the user permits a more comfortable accomodation allowing the user to keep its concentration longer. In addition, the rear panel 46 also contributes to block, to a certain degree, exterior disturbances that may enter the working area through the entryway of the canopy and cause distraction.

Depending on the specific application, various accessories may be mounted on the desk 36 for assisting the user in operating the computer. As an example, a folding keyboard bracket may be mounted to the main desk portion 40, to support a keyboard in the desired position. In addition, a footrest may also be provided under the desk 36, if desired.

When the workstation 10 is not in use, the seat 16 is moved to fully enter the canopy 14 so that the panel 46 abuts against the canopy 14. Any suitable lock may be provided between the canopy 14 and the panel 46 to keep the seat 16 in stored position for preventing unauthorized use of the workstation.

The above description of a preferred embodiment should not be interpreted in any limiting manner as this embodiment can be refined and varied in many ways without departing from the spirit of the invention. The scope of the invention is defined in the annexed claims.

The embodiments of the invention in which an exclusive property or privilege is claimed are defined as follows:

1. A workstation for providing a relatively isolated environment suitable for a user to interface during long time periods with a display screen, said workstation comprising:

a) an elongated canopy defining a relatively isolated working area dimensioned to at least partially accomodate a user adopting a reclining posture, said elongated canopy including at one end thereof an entryway allowing the user to access and exit said working area while in the reclining posture;

b) means for supporting a display screen mounted within said elongated canopy in a spaced apart relationship to said entryway to reduce display screen glare caused by ambient light; and c) a seat for supporting a user in a reclining posture, said seat being movable with relation to said canopy allowing a user to access and exit said working area through said entryway.

2. A workstation as defined in claim 1, further comprising:

a) a base plate, said canopy being mounted on said base plate; and b) track means on said base plate, said seat being mounted in said track means for movement relatively to said canopy.

3. A workstation as defined in claim 1, wherein said support means is a desk.

4. A workstation as defined in claim 2, further comprising a footrest mounted on said base plate.

5. A workstation as defined in claim 1, further comprising a panel mounted on a back of said seat, said panel constituting means to close said entryway when said seat is fully received in said working area.

6. A workstation as defined in claim 5, wherein said panel has a shape corresponding to the contour of said entryway.

7. A workstation as defined in claim 5, comprising lock means between said canopy and said panel to prevent movement of said seat out of said working area.

8. A workstation as defined in claim 1, wherein said elongated canopy has a closed end.

9. A workstation as defined in claim 1, wherein said canopy comprises a generally dome-shaped roof section.

10. A workstation as defined in claim 9, wherein said roof section includes a plurality of arched strips in a partially overlapping relationship.

* * * * *